US005233138A

United States Patent [19]

Amano

[11] Patent Number: 5,233,138

[45] Date of Patent: Aug. 3, 1993

[54] ELEVATOR CONTROL APPARATUS USING EVALUATION FACTORS AND FUZZY LOGIC

[75] Inventor: Masaaki Amano, Aichi, Japan

[73] Assignee: Mitsubishi Denki Kabushiki Kaisha, Tokyo, Japan

[21] Appl. No.: 713,087

[22] Filed: Jun. 11, 1991

[30] Foreign Application Priority Data

Jun. 15, 1990 [JP] Japan ..... 2-155351

[51] Int. Cl.[5] ..... B66B 1/14

[52] U.S. Cl. ..... 187/127; 187/124; 395/3

[58] Field of Search ..... 187/124, 127, 101; 364/513; 395/3

[56] References Cited

U.S. PATENT DOCUMENTS

| | | | |
|---|---|---|---|
| 4,760,896 | 8/1988 | Yamaguchi | 187/124 |
| 4,878,562 | 11/1989 | Schroder | 187/127 |
| 4,947,965 | 8/1990 | Kuzunuki et al. | 187/127 |
| 4,984,174 | 1/1991 | Yasunobu et al. | 364/513 |
| 5,022,498 | 6/1991 | Sasaki et al. | 187/127 |

*Primary Examiner*—Jeffrey A. Gaffin

*Attorney, Agent, or Firm*—Leydig, Voit & Mayer

[57] ABSTRACT

An elevator control apparatus includes a fuzzy rule base having fuzzy rules stored therein which govern the selection of an elevator cage to be assigned to respond to a call. A reasoning unit is provided for selecting the appropriate fuzzy rule to be applied to a cage. The reasoning unit selects the appropriate fuzzy rule according to evaluation factors such as the miss forecast rate and the estimation rate of the cages.

9 Claims, 7 Drawing Sheets

ELEVATOR CONTROL APPARATUS USING EVALUATION FACTORS AND FUZZY LOGIC

TECHNICAL FIELD

This invention relates to an elevator control apparatus for managing a plurality of elevator cages in a group.

BACKGROUND OF THE INVENTION

Generally, in elevator control apparatus for group supervising a plurality of elevator cages, a microcomputer is employed to process large amounts of information and to perform arithmetic operations, thereby realizing a precise cage control.

Heretofore, such elevator control apparatus supervise a plurality of elevator cages based only on presently registered hall calls. That is, such apparatus do not anticipate future hall calls. Consequently, cage assignment may become irregular because of unanticipated future hall calls.

Furthermore, such elevator control apparatus perform supervisory and control operations based on an evaluation function which is predetermined. These supervisory and control operations encompass assignment and choice of elevator cages and they are implemented through fixed logic. Accordingly, the supervisory and control operations are difficult to adjust as passenger traffic volume in the building changes.

SUMMARY OF THE INVENTION

It is an object of this invention to provide an elevator control apparatus which controls the cages such that they respond quickly to calls in a building.

Another object of this invention is to provide an elevator control apparatus which controls the cages dynamically according to the amount of past, present and predicted future traffic in a building.

Theses and other objects are realized by an elevator control apparatus incorporated with a plurality of elevator cages and hall controllers. The control apparatus includes a fuzzy rule base which stores rules that govern the selection of the elevator cage designated to respond to a specific call. An evaluation factor arithmetic unit is provided for calculating evaluation factors of the cages. A reasoning unit is included to select a rule stored in the fuzzy rule base according to the evaluation factors. An evaluation arithmetic unit is provided for calculating the evaluation value of the cages using an evaluation expression contained in the selected rule. The elevator cage to be assigned to respond to a call is identified as the cage with the smallest evaluation value by an assignment elevator choice unit.

DESCRIPTION OF THE ILLUSTRATED EMBODIMENT

Figure 1:
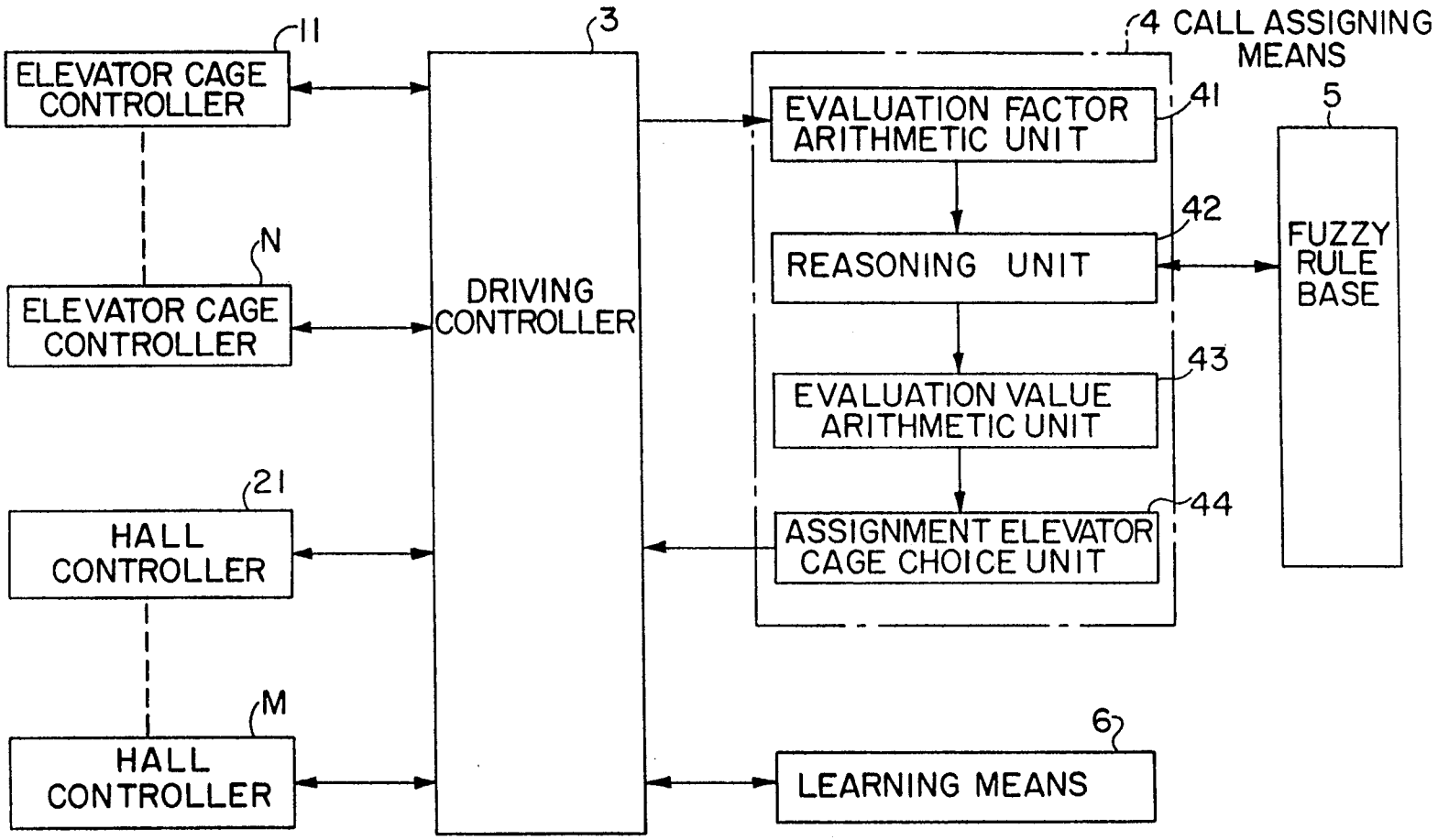
FIG. 1 is a block diagram of an elevator control apparatus according to the present invention.

Referring now to FIG. 1, an elevator control apparatus according to the present invention is depicted. The apparatus includes a number of elevator cage controllers 1-N which correspond to respective elevators and a number of hall controllers 2-M which correspond to respective up and down direction units of each hall. A driving controller 3 is connected to elevator cage controllers 1-N and hall controllers 2-M for generating driving commands which correspond to elevator conditions. A call assigning means 4 is connected to driver controller 3 for selecting elevator cages for assignment every time a call is placed. The cages are assigned based on a plurality of fuzzy rules written in IF-THEN form and stored in fuzzy rule base 5. Assignment of a selected cage further depends upon the traffic conditions of all of the cages. Accordingly, learning means 6 is provided for learning traffic conditions in the building.

With respect to cage selection, the call assigning means 4 includes an evaluation factor arithmetic unit 41 for calculating evaluation factors including an expectation arrival time for the elevator cages, a reasoning unit 42 for choosing the fuzzy rule which governs assignment of the individual elevator cages based on the condition of the elevator cages and the presence of a registered hall call. Assigning means 4 further includes an evaluation value arithmetic unit 43 for calculating a total evaluation value based on individual evaluation factors for selected conditions of the elevator cage to be assigned and an assignment elevator cage choice unit 44 for selecting the elevator cage to be assigned. Each unit in the call assigning means 4 can be comprised of a microcomputer or any other suitable device.

Figure 2:
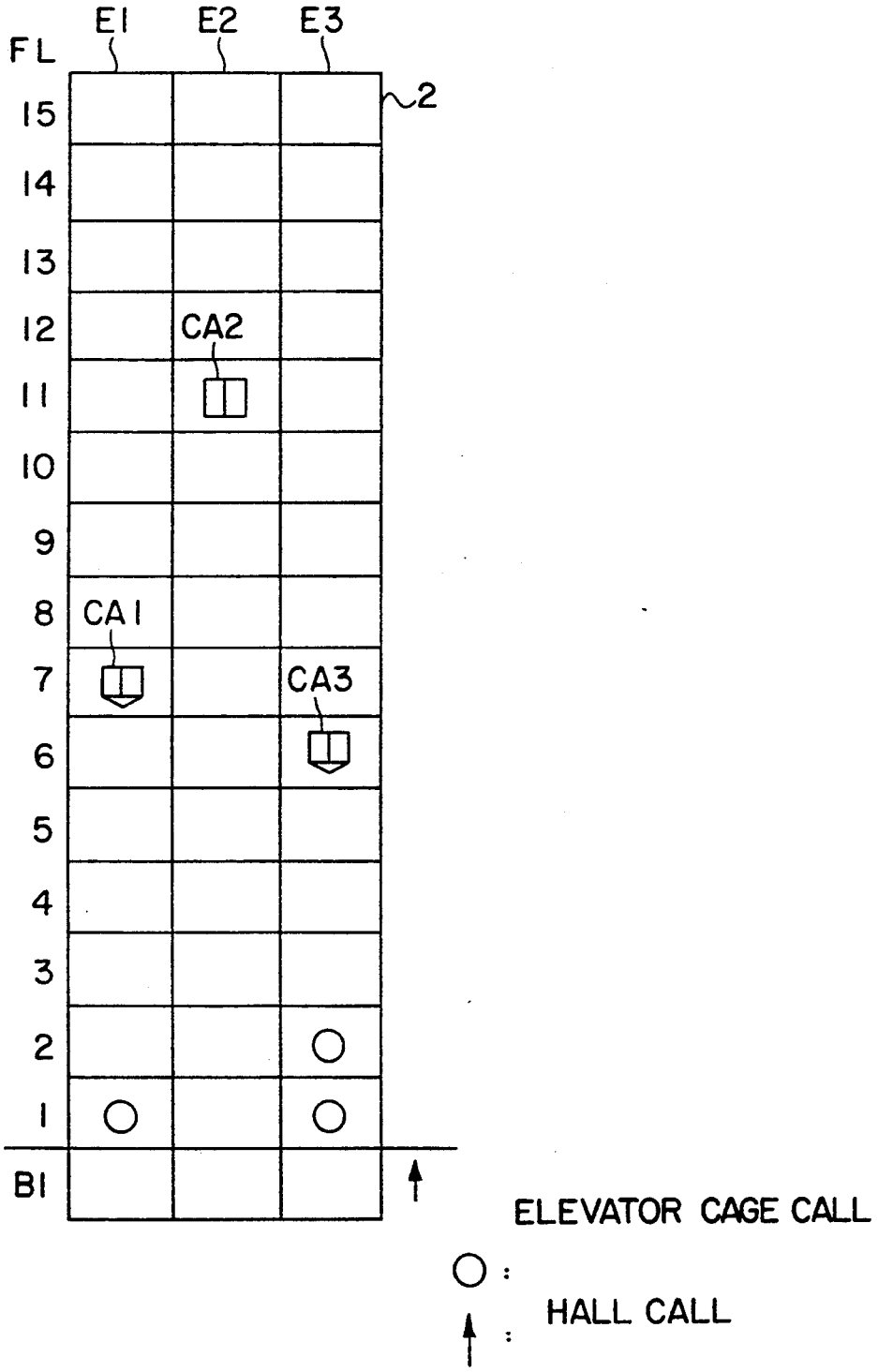
FIG. 2 depicts an example of a traffic state of elevator cages in a building.

Next, the operation of the present invention shown in FIG. 1 will be described by referring to the diagram illustrated in FIG. 2. elevators (in this case there are three) which are established in a building which has fifteen upper floors and an underground floor, the number of floors totaling sixteen. As illustrated in FIG. 2, elevator cage CA1 of a first elevator E1 is traveling downward on the seventh floor and has an elevator cage call (refer to a mark "o") on the first floor. An elevator cage CA2 of a second elevator E2 is awaiting a call on the eleventh floor having responded to a previous elevator cage call. An elevator cage CA3 of a third elevator E3 is traveling downward on the sixth floor and has an elevator cage call (refer to a mark "o") on the first and second floor.

Now, if a hall floor call is registered on the first underground floor B1, the call assigning means 4 selects an elevator cage to respond to the call. In this case, an arrival expectation time is calculated for each of the three elevator cages CA1–CA3. If a running time of each of the elevator cage CA1–CA3 is two seconds per one floor and a stop time for cages CA1–CA3 is ten seconds, the arrival expectation time is twenty four seconds on the elevator cage CA1, twenty two seconds on the elevator CA2, thirty two seconds on the elevator cage CA3. Therefore, due to its lesser waiting time, the elevator cage CA2 is chosen for assignment. However, in this case, all of the elevator cages are concentrated on the low level floors after few minutes. Hence, when a call is registered on a high level floor, the response time of the selected cage is very long. For avoidance of this problem, elevator cage CA1 is selected for assignment to the first underground floor B1. This permits CA2 to respond to high level floor calls while still promptly servicing the underground hall call (refer to a mark "↑") since the estimated time for CA1 to reach B1 is only two seconds more than the estimated time for CA2 to reach B1.

Figure 3:
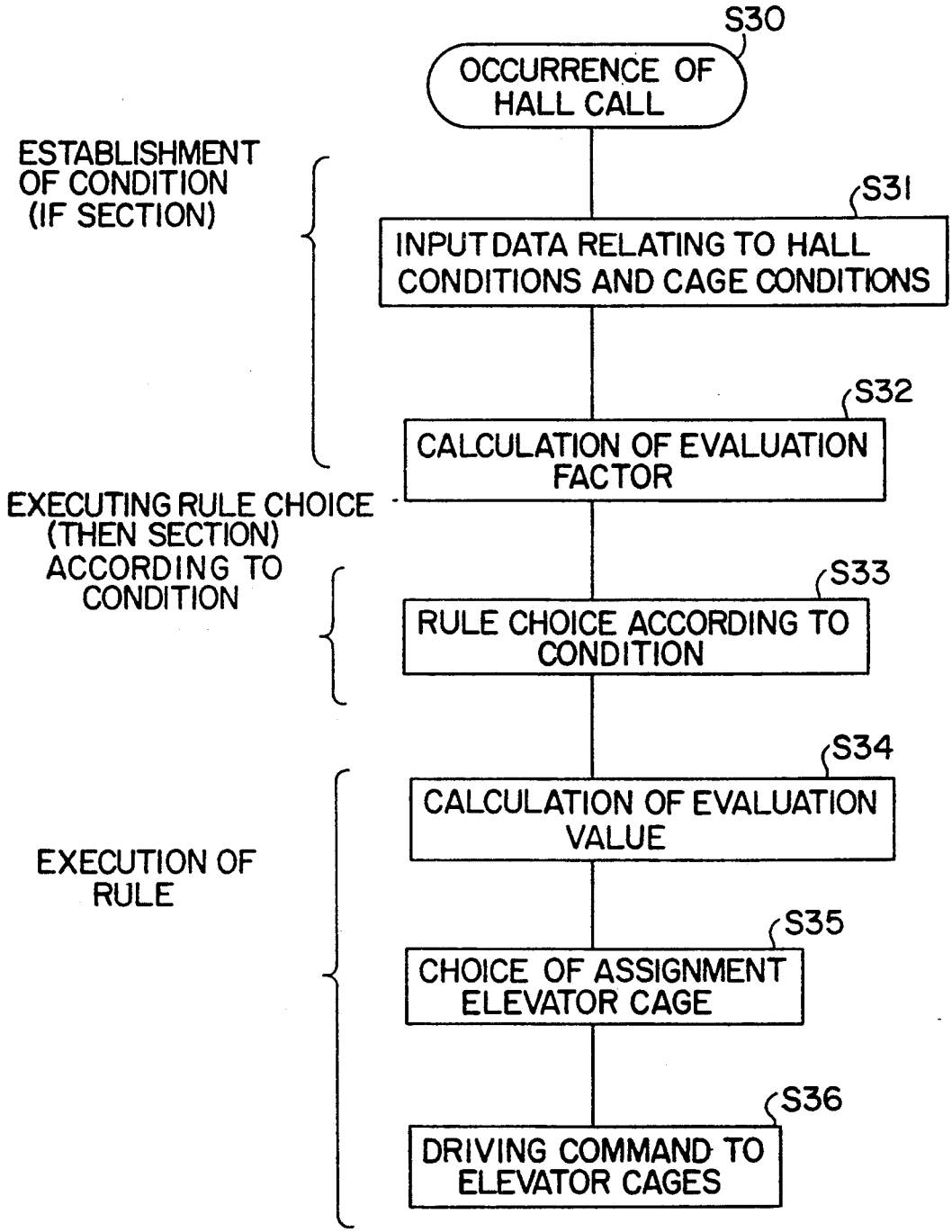
FIG. 3 is a flow chart for explaining the operation of the control apparatus according to the present invention.

Referring now to FIG. 3, when a hall call is registered on a selected floor (refer to step S30), data relating to elevator driving conditions and data relating to hall conditions on each of the floors is transferred to the call assigning means 4 through the driving controller 3 in step S31. At step S32, the evaluation factor arithmetic unit 41 of the call assigning means 4 calculates numerous evaluation factors. For example, a pass rate for a full car which is an estimation rate and an evaluation factor of a miss forecast rate are calculated. The estimation rate estimates the likelihood that the elevator car passes a floor having an outstanding hall call when the car is full. The miss forecast rate estimates the likelihood that other elevator cages arrive at a predetermined floor earlier than the elevator cage which was estimated to be the first to arrive at the predetermined floor. Then, in step S33, a rule for choice of the elevator cage is selected. The rule is selected from fuzzy rule base 5 by the reasoning unit 42 based on conditions of each elevator cage such as cage position and evaluation factors. In step S35 the elevator cage with the smallest total evaluation value, calculated at step S34, is selected as an assignment elevator cage. After selection of the assignment elevator cage, the necessary information to drive the assigned cage is transferred through the driving controller 3 to each elevator cage and each floor in step S36.

Figure 4:
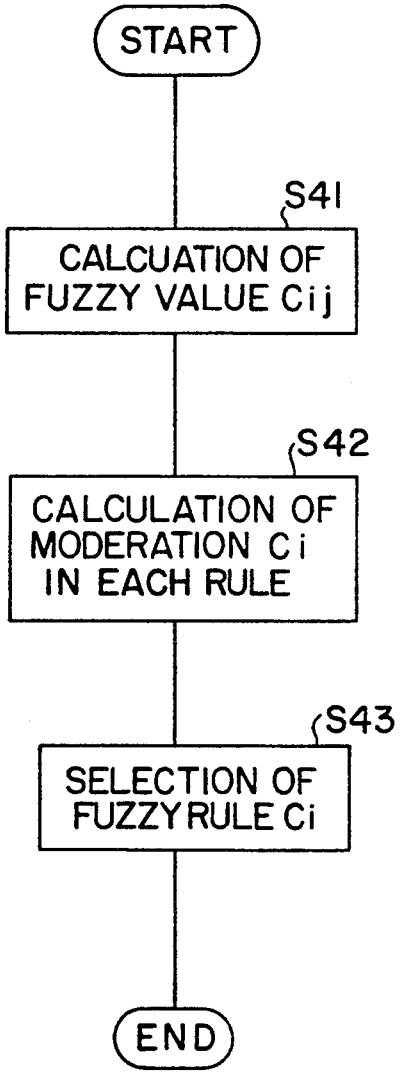
FIG. 4 is a flow chart for explaining the operation of the fuzzy rule base of the instant invention.
Figure 5A:
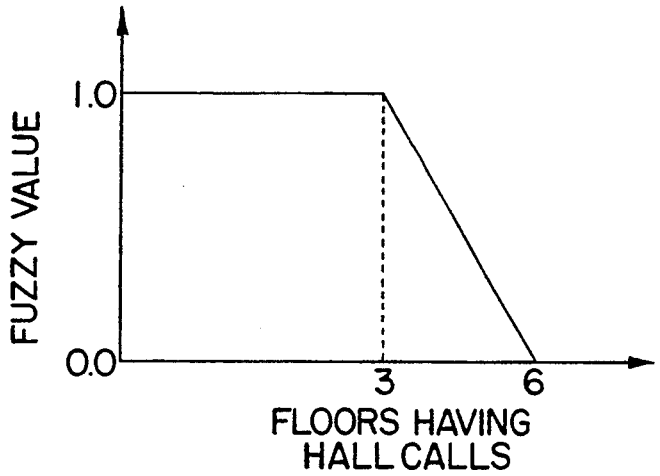
FIGS. 5(*a*)–(*d*) are illustrations of various membership functions used in the selection of fuzzy rules.
Figure 5B:
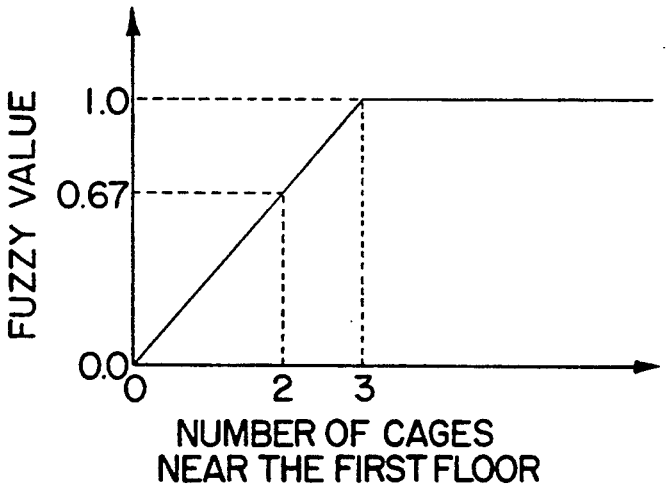
Figure 5C:
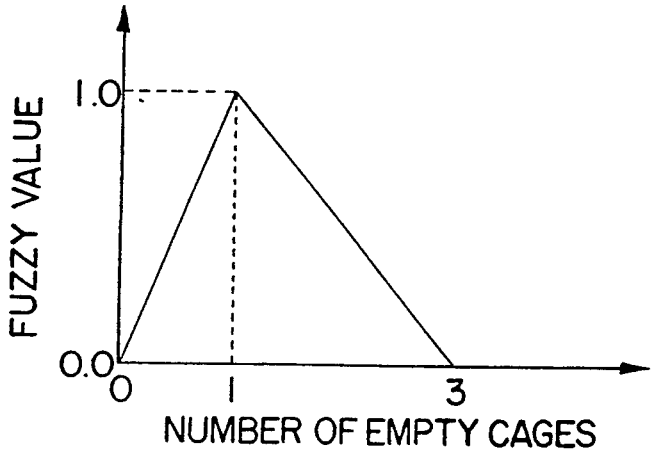
Figure 5D:
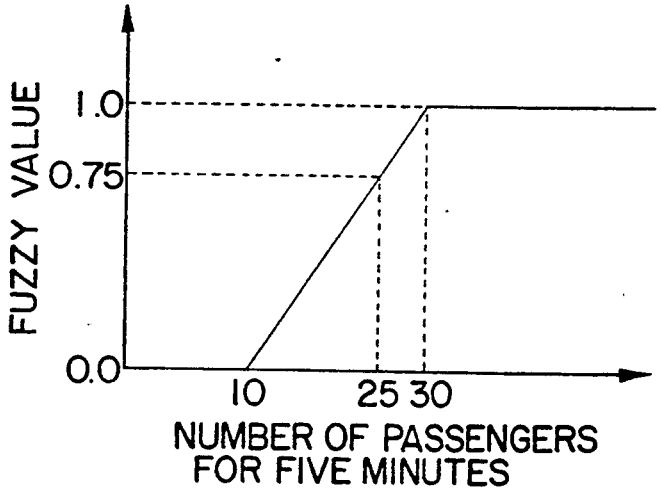

With reference to FIG. 4, the fuzzy rules will now be explained. Fuzzy rules are written in IF-THEN format and are composed of information obtained from simulation and past experience in group supervision of elevator cages.

Figure 6:
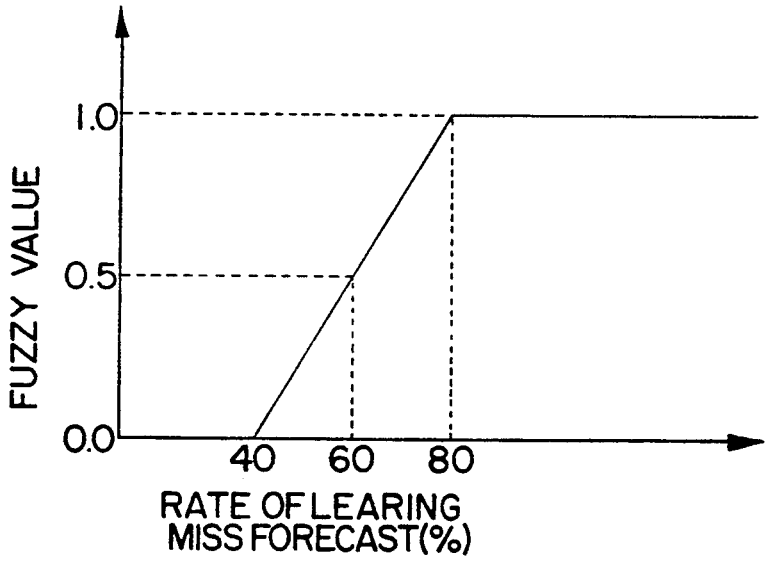
FIG. 6 is a further illustration of a membership function used in the selection of fuzzy rules.

A condition section (IF section) contains informational parameters which indicate the occurence of certain conditions. The process of determining whether these certain conditions exist is called fitting moderation. Each condition is defined by a membership function (see FIGS. 5 and 6). The value of the function lies between 0 and 1 and it is defined as the fuzzy value.

The executing section (THEN section) contains the procedure to be executed when the fuzzy rule is chosen.

Now, selection of a suitable cage will be explained. In step S41 fuzzy values $C_{ij}$ are calculated for several fuzzy rules. In this case, $C_{ij}$ means a fuzzy value on the condition section of j of fuzzy rule i.

Then, in step S42, fitting moderations are calculated on each fuzzy rule based on the following expression:

$$C_i = \min \{C_{i1}, C_{i2} \ldots\}$$

where $C_i$ is defined as a fitting moderation on fuzzy rule i.

After calculation of the fitting moderations $C_i$, the fuzzy rule having the biggest fitting moderation is chosen and executed in step S43.

Now, calculation of the fitting moderation is explained with reference to FIG. 2.

Fuzzy rules are defined as follow:

Rule 1

IF (conditions):

1) A new hall call is registered on low level floor.
2) There are a large number of elevator cages which are expected to be idle at a low level floor area after predetermined time.
3) There are a few empty elevator cages at the present time.
4) A traffic condition exists wherein hall calls often occur in the high level floor area.

THEN (execution):

1) Evaluation Expression = Evaluation Value of Waiting Time + a × (Evaluation Value of Miss Forecast) + b × (Evaluation Value of Full Car) where "a" and "b" are both coefficients; and
2) the cage to be assigned is a cage which is not empty and is able to respond to a call.

The fuzzy values which are written on each condition section (IF section) are derived from the membership functions which are depicted in FIGS. 5(*a*) −(*d*).

Referring to condition 1) in the IF section, according to FIG. 5(*a*), fuzzy value $C_{11} = 1.0$ because a hall call is registered at the first underground floor.

Referring to condition 2), according to FIG. 5(*b*), fuzzy value $C_{12} = 0.67$ because it is expected that elevator cages CA1 and CA2 are near the first floor.

Referring to condition 3) according to FIG. 5(*c*), fuzzy value $C_{13} = 1.0$ because an empty elevator cage exits at the present time.

Referring to condition 4), according to FIG. 5(*d*), fuzzy value $C_{14} = 0.75$ when the learning means 6 determines that the number of passengers for five minutes is about twenty five on a selected floor. (Number of passengers is forecasted by the learning means 6.)

Therefore, the fuzzy values obtained according to the procedure of FIG. 4 are:

$C_{11} = 1.0$ $C_{12} = 0.67$ $C_{13} = 1.0$ $C_{14} = 0.75$

The fitting moderation on rule 1 then becomes $C_1 = 0.67$.

In addition, they are the same as above on other rules.

Rule 2

IF(condition):

1) A new hall call is registered on a floor which has a high miss forecasting rate.

THEN(execution):

1) Evaluation Expression = Evaluation Value of Waiting Time (Only on the floor which has registered a new hall call); and
2) the cage to be assigned is an elevator cage which can respond and which has a pass rate for full car which is less than a predetermined value on a floor which has a new hall call.

In the condition section (IF section), the fitting moderation is obtained based on the miss forecasting rates which are calculated using the statistics on each floor and the direction determined by the learning means 6. Therefore, if a learning miss forecasting rate of a floor which has a hall call is 60% according to FIG. 6, the fitting moderation $C_2$ is 0.5 for rule 2. When this value is greater than the fitting moderation for rule 1, the executing section (THEN section) is executed on rule 2. Then, through execution of rule 2, the elevator cage has a pass rate for a full car which is less than a predetermined value and which has the smallest evaluation value of waiting time is selected.

According to the present invention as described above, a traffic condition of both present time and future is obtained as a fuzzy value on each of the floors having registered hall calls. The traffic condition is forecasted based on this fuzzy value. Accordingly, a suitable cage can be selected and assigned to a floor having a registered hall call based on the calculated evaluation factor and elevator cage information. An advantage is provided in that as the traffic patterns and environment in the building change, the selection process for choosing an elevator cage is modified to reflect those changes.

The illustrated embodiment having been described, it should be noted that numerous variations, modifications and other embodiments will become apparent to a person having ordinary skill in the art.

I claim:

1. An elevator control apparatus for supervising a plurality of elevator cages in a building comprising:

a fuzzy rule base having fuzzy rules stored therein which govern the selection of an optimum elevator cage to be assigned to respond to a call; and a reasoning unit for selecting the fuzzy rule to be employed in group supervision based on evaluation factors including a miss forecast rate and an estimation rate, so that the cage which can respond to a call while causing the least system delay is identified by said fuzzy rule base and said reasoning unit, the miss forecast rate being defined as the likelihood that an elevator cage estimated to be the first to arrive at a predetermined floor arrives at the predetermined floor subsequent to other cages;

a driving controller connected to said reasoning unit for driving the elevator cage identified by said fuzzy rule base and said reasoning unit.

2. An elevator control apparatus for supervising a plurality of elevator cages in a building, comprising:

an evaluation factor arithmetic unit for calculating evaluation factors including a miss forecast rate and an estimation rate, the miss forecast rate being defined as the likelihood that an elevator cage estimated to be the first to arrive at a predetermined floor arrives at the predetermined floor subsequent to other cages;

a reasoning unit for selecting a rule governing choice of elevator cages based on said evaluation factors;

an evaluation value arithmetic unit for calculating an evaluation value based on an evaluation expression which is contained in the selected rule;

an assignment elevator cage choice unit for identifying the elevator cage having the smallest evaluation value as a cage to be assigned; and a fuzzy rule base having evaluation expressions stored therein defining the rules governing choice of elevator cages; and a driving controller connected to said evaluation factor arithmetic unit and said evaluation value arithmetic unit for driving the elevator cage specified by said assignment elevator cage choice.

3. An elevator control apparatus as set forth in claim 2 further comprising a learning means for determining traffic conditions in a building.

4. An elevator control apparatus as set forth in claim 2 wherein the evaluation factor is an expectation arrival time for an elevator cage.

5. An elevator control apparatus as set forth in claim 2 wherein said reasoning unit determines the rule to be chosen based on the existence of predetermined conditions.

6. An elevator control apparatus for supervising a plurality of elevator cages in a building, comprising:

an evaluation factor arithmetic unit for calculating evaluation factors, including a miss forecast rate and an estimation rate, the miss forecast rate being defined as the likelihood that an elevator cage estimated to be the first to arrive at a predetermined floor arrives at the predetermined floor subsequent to other cages;

a reasoning unit for selecting a rule governing choice of elevator cages based on said evaluation factors;

an evaluation value arithmetic unit for calculating an evaluation value based on an evaluation expression which is contained in the selected rule;

an assignment elevator cage choice unit for identifying the elevator cage having the smallest evaluation value as a cage to be assigned;

a fuzzy rule base having evaluation expressions stored therein defining the rules governing choice of elevator cages;

a driving controller connected to said evaluation factor arithmetic unit and said evaluation value arithmetic unit for transmitting cage and hall information to said evaluation factor arithmetic unit and for driving the cage to be assigned; and a learning means connected to said driving controller for determining traffic in the building;

whereby the cage that is assigned to respond to the hall call is the cage which can most quickly arrive at the hall call location without causing a long delay in responding to other hall calls.

7. A method for driving elevator cars comprising the steps of:

estimating the amount of time needed for respective elevator cars to arrive at a predetermined floor and designating the estimated time as an arrival time;

determining the probability that a first elevator car passes a floor having an outstanding hall call when the first car is full;

determining the probability that other elevator cars arrive at a predetermined floor before the car having the shortest calculated arrival time;

calculating a total evaluation values according to an evaluation expression;

driving the elevator car having the smallest evaluation value to respond to the outstanding call.

8. A method of driving an elevator car according to claim 7 wherein the evaluation expression is as follows:

$$\text{Evaluation Expression} = e + (a) \times (f) + (b) \times (g);$$

where e=Evaluation Value of Waiting Time, f=Evaluation Value of Miss Forecast, g=Evaluation Value of full car, and a and b are coefficients.

9. A method of driving an elevator car according to claim 7 wherein the evaluation expression is as follows:

$$\text{Evaluation Expression} = e;$$

where e=Evaluation Value of Waiting time.

* * * * *

UNITED STATES PATENT AND TRADEMARK OFFICE

CERTIFICATE OF CORRECTION

PATENT NO. : 5,233,138

DATED : August 3, 1993

INVENTOR(S) : Masaaki Amano

It is certified that error appears in the above-indentified patent and that said Letters Patent is hereby corrected as shown below:

Claim 2, column 5, line 65, after "choice" insert --unit--.

Signed and Sealed this

Twenty-ninth Day of March, 1994

Bruce Lehman

*Attest:*

BRUCE LEHMAN

*Attesting Officer*

*Commissioner of Patents and Trademarks*